US012727684B2

(12) United States Patent
Cheng et al.

(10) Patent No.: US 12,727,684 B2
(45) Date of Patent: Sep. 8, 2026

(54) DETACHABLE BABY CARRIER

(71) Applicant: WONDERLAND SWITZERLAND AG, Steinhausen (CH)

(72) Inventors: Manqun Cheng, Steinhausen (CH); Meifeng Fan, Steinhausen (CH)

(73) Assignee: WONDERLAND SWITZERLAND AG, Steinhausen (CH)

( * ) Notice: Subject to any disclaimer, the term of this patent is extended or adjusted under 35 U.S.C. 154(b) by 310 days.

(21) Appl. No.: 18/259,251

(22) PCT Filed: Dec. 14, 2021

(86) PCT No.: PCT/EP2021/085749
§ 371 (c)(1),
(2) Date: Jun. 23, 2023

(87) PCT Pub. No.: WO2022/136029
PCT Pub. Date: Jun. 30, 2022

(65) Prior Publication Data

US 2024/0057785 A1 Feb. 22, 2024

(30) Foreign Application Priority Data

Dec. 24, 2020 (CN) ..... 202011544603.X

(51) Int. Cl.
*A47D 13/02* (2006.01)

(52) U.S. Cl.
CPC ..... *A47D 13/025* (2013.01)

(58) Field of Classification Search
CPC .. A47D 13/02; A47D 13/025; A45F 2005/026
(Continued)

(56) References Cited

U.S. PATENT DOCUMENTS 1,325,446 A * 12/1919 Lukianoff ..... A45C 13/185 24/3.5
5,246,152 A * 9/1993 Dotseth ..... A47D 13/025 224/159

(Continued)

FOREIGN PATENT DOCUMENTS

CN 201480773 U 5/2010
CN 203693077 U 7/2014

(Continued)

OTHER PUBLICATIONS

International Search Report issued in corresponding International Application No. PCT/EP2021/085749, dated Apr. 14, 2022, pp. 1-2, European Patent Office, Rijswijk, Netherlands.

(Continued)

*Primary Examiner* — Adam J Waggenspack
(74) *Attorney, Agent, or Firm* — HAUPTMAN HAM, LLP

(57) ABSTRACT

A detachable baby carrier includes two shoulder straps and a support member, a space for receiving a baby formed by the shoulder straps and the support member, each shoulder strap has a first connecting end and a second connecting end which are respectively connected to the support member, and the first connecting end is detachably connected to the support member. When in use, the first connecting end can be detached from the support member when there is a need to breastfeed, so that the shoulder strap can be easily moved thereby providing space for mothers to breastfeed their babies, which is convenient.

19 Claims, 12 Drawing Sheets

(58) Field of Classification Search
USPC ..... 224/158–160
See application file for complete search history.

(56) References Cited

U.S. PATENT DOCUMENTS

| | | | | |
|---|---|---|---|---|
| 5,319,836 | A * | 6/1994 | Ida | A44B 11/263 24/616 |
| 5,732,861 | A * | 3/1998 | Jakobson | A44B 11/2549 224/160 |
| 6,598,771 | B2 * | 7/2003 | Norman | A47D 13/025 224/160 |
| 8,261,417 | B2 * | 9/2012 | Yoshiguchi | A44B 11/2592 24/578.11 |
| 8,333,310 | B2 * | 12/2012 | Tages | A45F 5/021 224/668 |
| 10,076,194 | B2 * | 9/2018 | Wikner | A47D 13/025 |
| 2005/0242136 | A1 * | 11/2005 | Moriguchi | A47D 13/025 224/160 |
| 2006/0186152 | A1 * | 8/2006 | Williams | A45F 5/02 224/269 |
| 2008/0283559 | A1 | 11/2008 | Parness et al. | |
| 2010/0170927 | A1 | 7/2010 | Warner | |
| 2015/0181984 | A1 * | 7/2015 | Wikner | A44B 11/2546 24/614 |
| 2020/0113350 | A1 * | 4/2020 | Warner | A47D 13/02 |

FOREIGN PATENT DOCUMENTS

| | | | |
|---|---|---|---|
| CN | 204393948 | U | 6/2015 |
| CN | 207979394 | U | 10/2018 |
| CN | 109757929 | A | 5/2019 |
| CN | 109892909 | A | 6/2019 |
| CN | 209284724 | U | 8/2019 |
| CN | 210138005 | U | 3/2020 |
| TW | 200605822 | A | 2/2006 |

OTHER PUBLICATIONS

Taiwan First Office Action issued in corresponding Taiwan Patent No. TW110148241, pp. 1-7.
First Office Action in Corresponding Chinese Application No. 202011544603.X, dated Jul. 30, 2024; 12 pgs.
Notice of Grant in Corresponding Chinese Application No. 202011544603.X, dated May 29, 2025; 6 pgs.

* cited by examiner

DETACHABLE BABY CARRIER

CROSS-REFERENCE TO RELATED APPLICATIONS

The present application is a national phase application under 35 U.S.C. 371 of International Application No. PCT/EP2021/085749 filed on Dec. 14, 2021, which claims priority to Chinese Application No. 202011544603.X filed on Dec. 24, 2020, the entire contents of which are incorporated herein by reference.

FIELD

One or more embodiments of the present disclosure relate to a technical field of baby carriers, in particular to a detachable baby carrier.

BACKGROUND

Baby carriers allow more and more parents to carry the babies comfortably while maintaining freedom of hand, and include other advantages of safety, stability and labor saving, and thus have been widely used. With the improvement of living standards, baby carriers have been developed rapidly and become common auxiliary tools for infants and toddlers. There are generally two carrier modes of a baby carrier to support the weight of babies, including a back mode and a front mode. For babies who need to be breastfed and have undeveloped neck muscles, the front mode is usually used as the infants can face to the parent, so that the parent can timely observe the baby's state to avoid possible dangers of suffocation due to squeezing of the nose and mouth. For the front mode baby carrier, two shoulder straps are generally used to connect with a support member that bears the weight of the infant. However, such shoulder straps may obstruct the mother to breastfeed, and one of the shoulder straps must be removed from the shoulder for breastfeeding, which is quite inconvenient.

BRIEF DESCRIPTION OF THE DRAWINGS

The accompanying drawings facilitate an understanding of the various embodiments of the present disclosure. In such drawings.

TABLE OF REFERENCE NUMERALS

Figure 1:
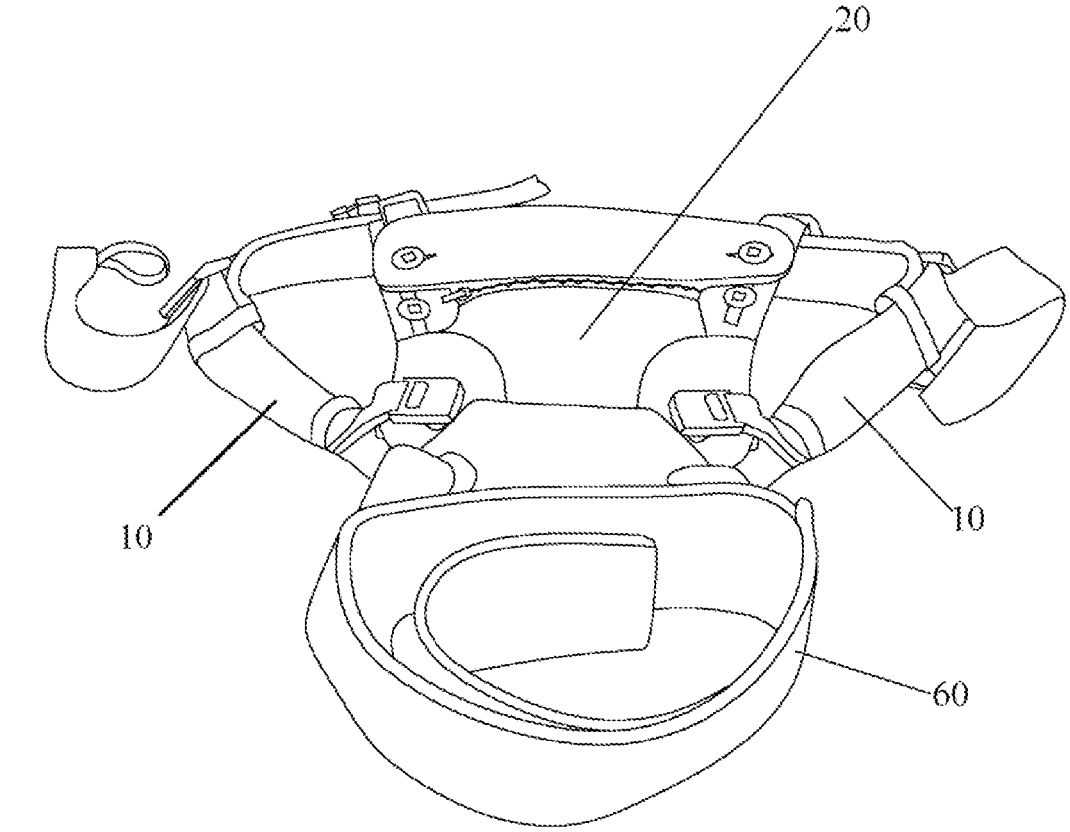
FIG. 1 is a perspective view of a detachable baby carrier according to one embodiment of the present disclosure.

| | | | |
|---|---|---|---|
| 100 | detachable baby carrier | 313 | second limiting slot |
| 10 | shoulder strap | 315 | recess |
| 11 | first connecting end | 317 | sidewall |
| 111 | button hole | 40 | female buckle |
| 113 | mounting portion | 41 | housing |
| 13 | second connecting end | 411 | penetrating slot |
| 15 | shoulder contact section | 413 | first limiting slot |
| 20 | support member | 415 | limiting plate |
| 211 | connector | 417 | reinforcing member |
| 23 | auxiliary portion | 43 | tongue |
| 231 | button | 431 | locking portion |
| 25 | seat portion | 433 | driving portion |
| 30 | male buckle | 50 | connecting band |
| 31 | base plate | 60 | waistband |
| 311 | protrusion portion | | |

DETAILED DESCRIPTION

Several embodiments of the present disclosure will now be described with reference to the accompanying drawings, in which the same reference numerals represent the same elements.

Figure 2:
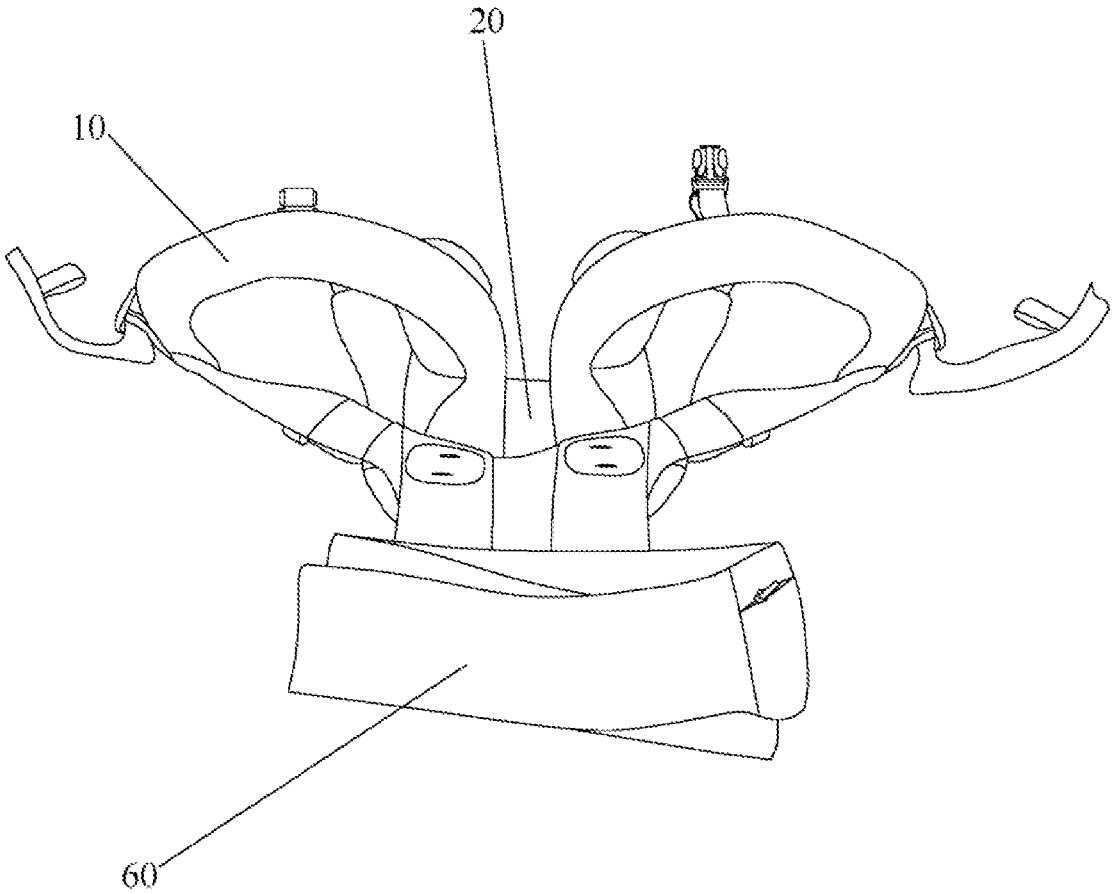
FIG. 2 is another perspective view of the detachable baby carrier of FIG. 1.
Figure 3:
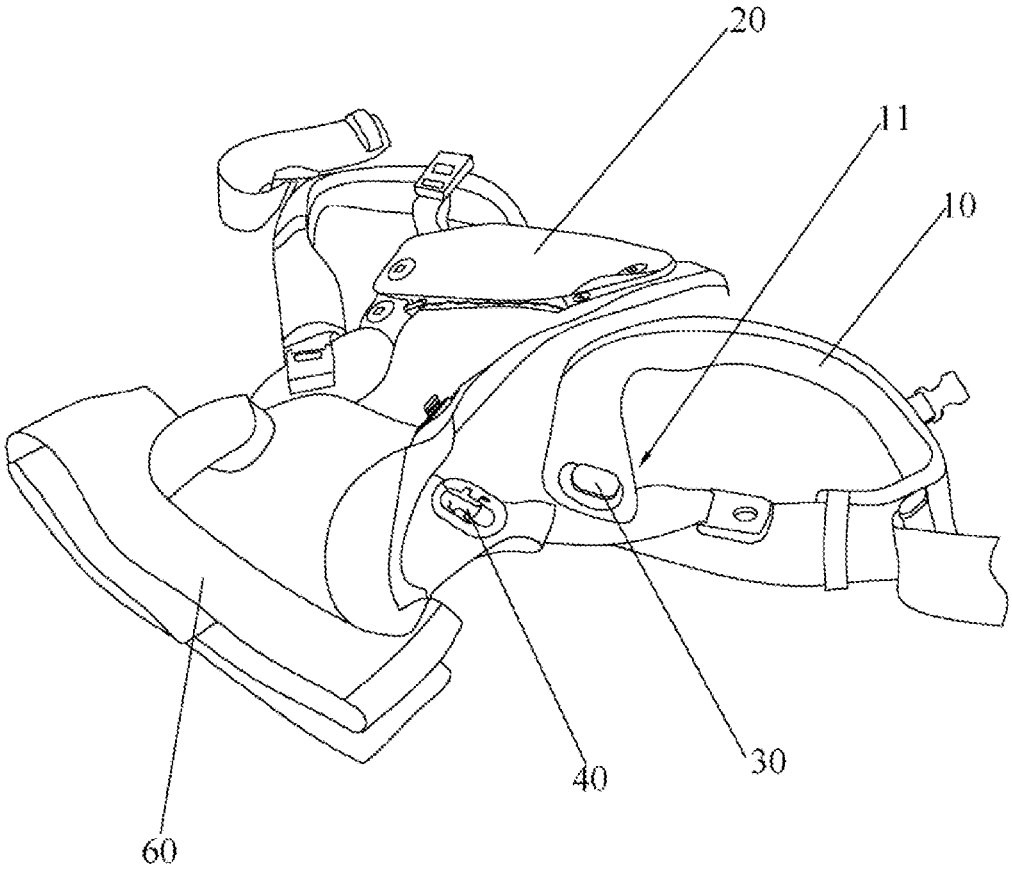
FIG. 3 is another perspective view of the detachable baby carrier of FIG. 1.

Referring to FIGS. 1 to 3, a detachable baby carrier 100 according to one embodiment of the present disclosure includes two shoulder straps 10, a support member 20 and a waistband 60. The two shoulder straps 10 are formed to allow wearers to wear the carrier 100 on their shoulders, and a space for receiving a baby is formed by the shoulder straps and the support member 20. Each shoulder strap 10 has a first connecting end 11 (FIG. 3), a second connecting end 13 (FIG. 5) and a shoulder contact section 15 (FIG. 5) located between the first connecting end 11 and the second connecting end 13, and the shoulder contact section 15 mainly refers to that section of the shoulder strap 10 which rests on the wearer's shoulder. The first connecting end 11 and the second connecting end 13 are connected to the support member 20, and the first connecting end 11 is detachably connected to the support member 20. Specifically, the support member 20 includes a connector 211 connected to a position of the shoulder strap 10 between the first connecting end 11 and the shoulder contact section 15, thereby further enhancing the connection between the support member 20 and the shoulder straps 10. The waistband 60 is connected with the support member 20 and configured to fix with the waist of the wearer in a detachable manner of hook and loop fasteners or buckles, for example.

Figure 5:
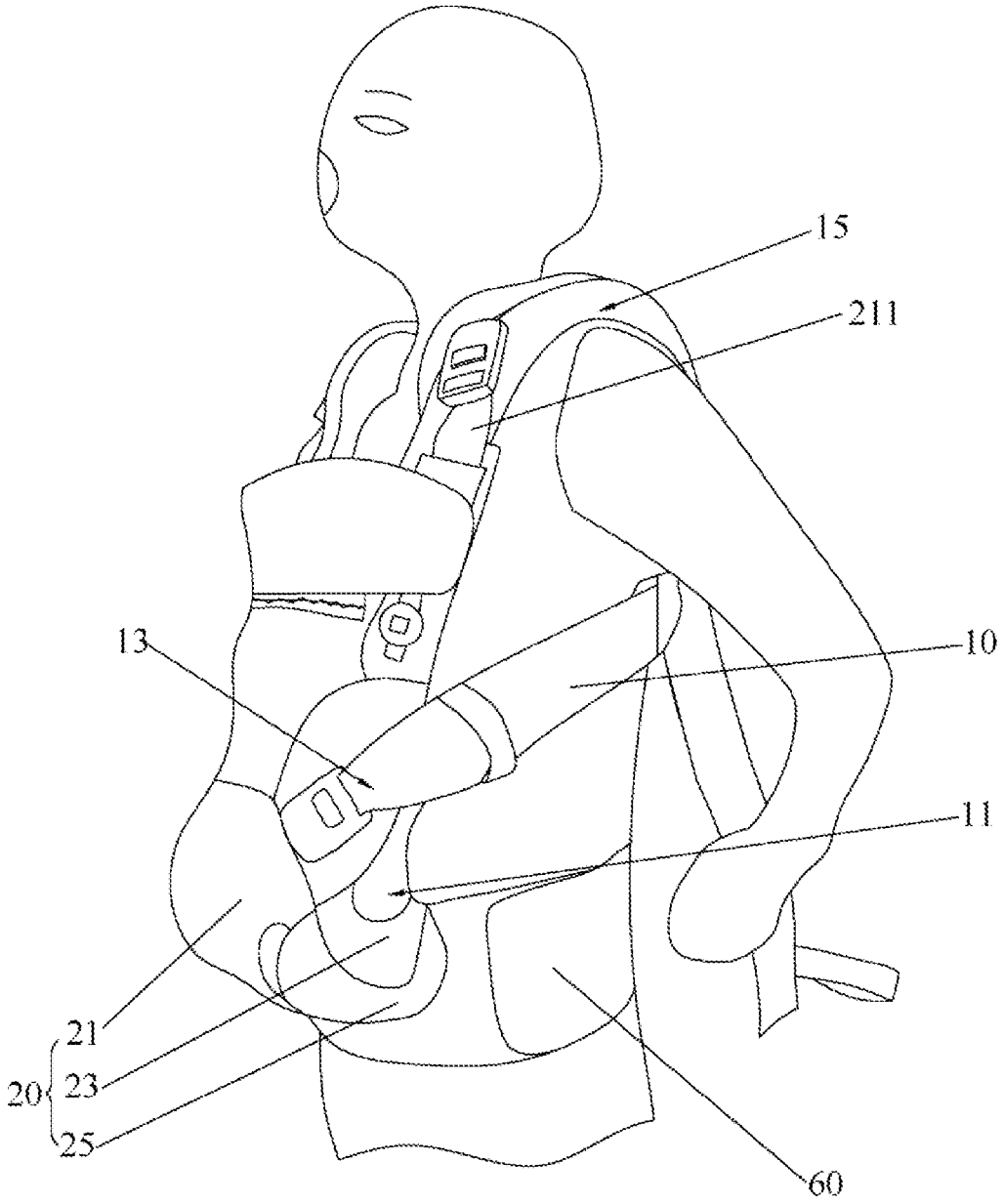
FIG. 5 is a diagrammatic representation illustrating a usage status of the detachable baby carrier, showing that the shoulder straps are buckled.
Figure 6:
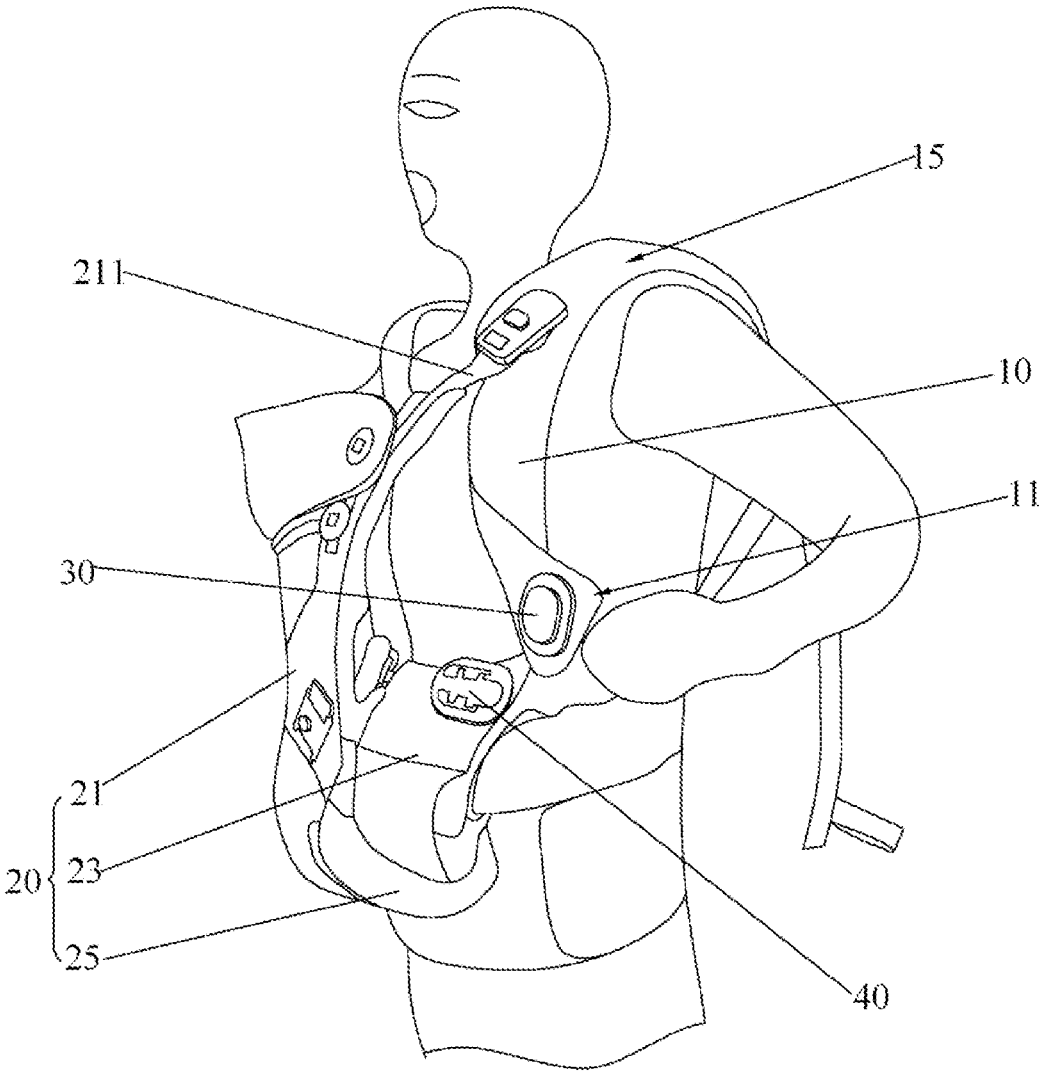
FIG. 6 is a diagrammatic representation illustrating another usage status of the detachable baby carrier, showing that the shoulder straps are detached.

Referring to FIGS. 5-6, the support member 20 includes a backrest 21, an auxiliary portion 23 and a seat portion 25. Specifically, the seat portion 25 is configured to receive and support the hip of the baby, and the backrest 21 is configured to support the back of the baby. The first connecting end 11 is detachably connected to the auxiliary portion 23, one end of the connector 211 is connected to the backrest 21, and the other end of the connector 211 is connected to the shoulder strap 10 between the first connecting end 11 and the shoulder contact section 15. In at least one embodiment, the connection between the connector 211 and the shoulder strap 10 is a detachable connection. In at least one embodiment, the second connecting end 13 is detachably connected to the backrest 21.

Figure 4:
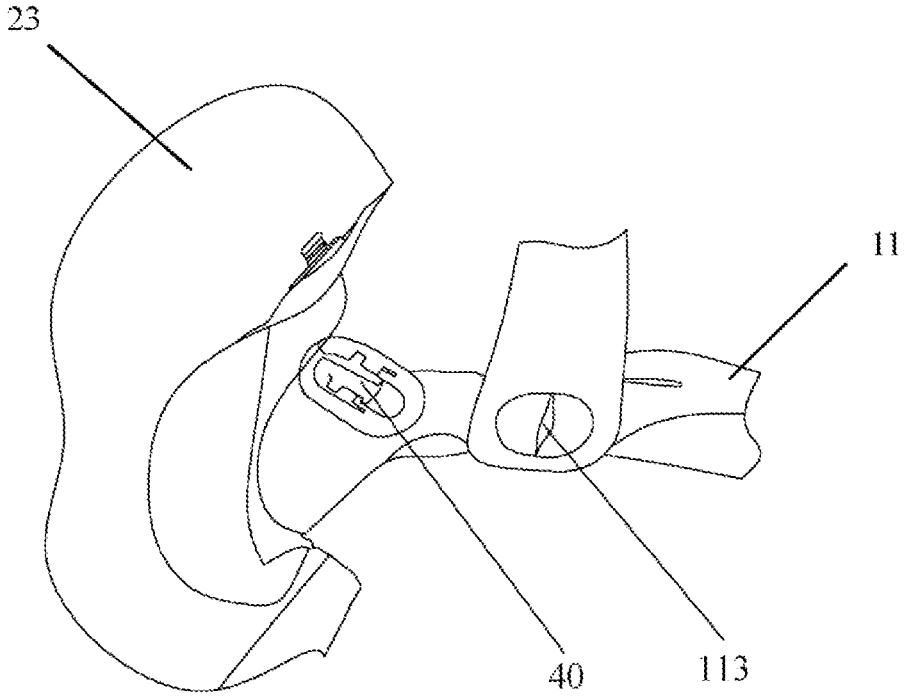
FIG. 4 is a partial view of the detachable baby carrier of FIG. 3, wherein a male buckle is hidden.

Referring to FIGS. 5-6, one of the first connecting end 11 or the auxiliary portion 23 is provided with a male buckle 30, and the other of the first connecting end 11 or the auxiliary portion 23 is provided with a female buckle 40 which is detachably matched with the male buckle 30. In this embodiment, the first connecting end 11 is provided with a male buckle 30, and the auxiliary portion 23 is provided with a female buckle 40; in such a cooperation, the first connecting end 11 of the shoulder strap 11 is conveniently detachable from the auxiliary portion 23, so that the shoulder strap 11 can be removed to provide space for a mother to breastfeed. Furthermore, the first connecting end 11 is provided with a mounting portion 113 (FIG. 4) located at an inner side of the first connecting end 11 in which the male buckle 30 is sewn, to obtain a neat appearance. Of course, it is also possible to provide a female buckle 40 on the first connecting end 11 and a male buckle 30 on the auxiliary portion 23, thereby achieving a quick detachment, which is not limited here.

Referring to FIGS. 8-12, the female buckle 40 includes a housing 41 having a penetrating slot 411 and a tongue 43 extended from a side wall of the penetrating slot 411. The tongue 43 includes a locking portion 431 and a driving portion 433, and a first limiting slot 413 is provided on the housing 411. The male buckle 30 includes a base plate 31 that is partially bulged to form a protrusion portion 311, and a second limiting slot 313 is provided on the protrusion portion 311 to cooperate with the first limiting slot 413. Specifically, a recess 315 is formed on the protrusion portion 311 to engage with the locking portion 431, and the driving portion 433 is operated to make the recess 315 disengage from the locking portion 431, thereby detaching the female buckle 40 and the male buckle 30. In other words, under the cooperation of the first limiting slot 413 and the second limiting slot 313, the male buckle 30 moves along the sliding direction of the first limiting slot 413 and the second limiting slot 313, and the recess 315 is engaged with the locking portion 431. Once the driving portion 433 is pressed, the locking portion 431 is disengaged from the recess 315 to cause the male buckle 30 to disengage from the first limiting slot 413, so that the first connecting end 11 and the auxiliary portion 23 are detached, as shown in FIG. 5. Specifically, the locking portion 431 has a sloped shape, which facilitates the recess 315 to disengage from the locking portion 431 when the driving portion 433 is pressed. Further, the housing 41 includes two limiting plates 415 that are bent toward each other to form the first limiting slot 413 with an opening. The protrusion portion 311 has two sidewalls 317 that are extended oppositely and extended into the first limiting slot 413 to form the second limiting slot 313. That is to say, the sidewalls 317 are extended into and engaged with the first limiting slot 413, and the detachment will not be operated until the first limiting slot 413 slides out. Furthermore, the driving portion 433 that protrudes is provided at the side of the tongue 43 that faces toward the male buckle 30, which facilitates the operation of the driving portion 433. In addition, in order to improve the supporting strength of the tongue 43, a reinforcing member 417 is provided between the housing 41 and the locking portion 431 along the extending direction of the tongue 43.

Figure 7:
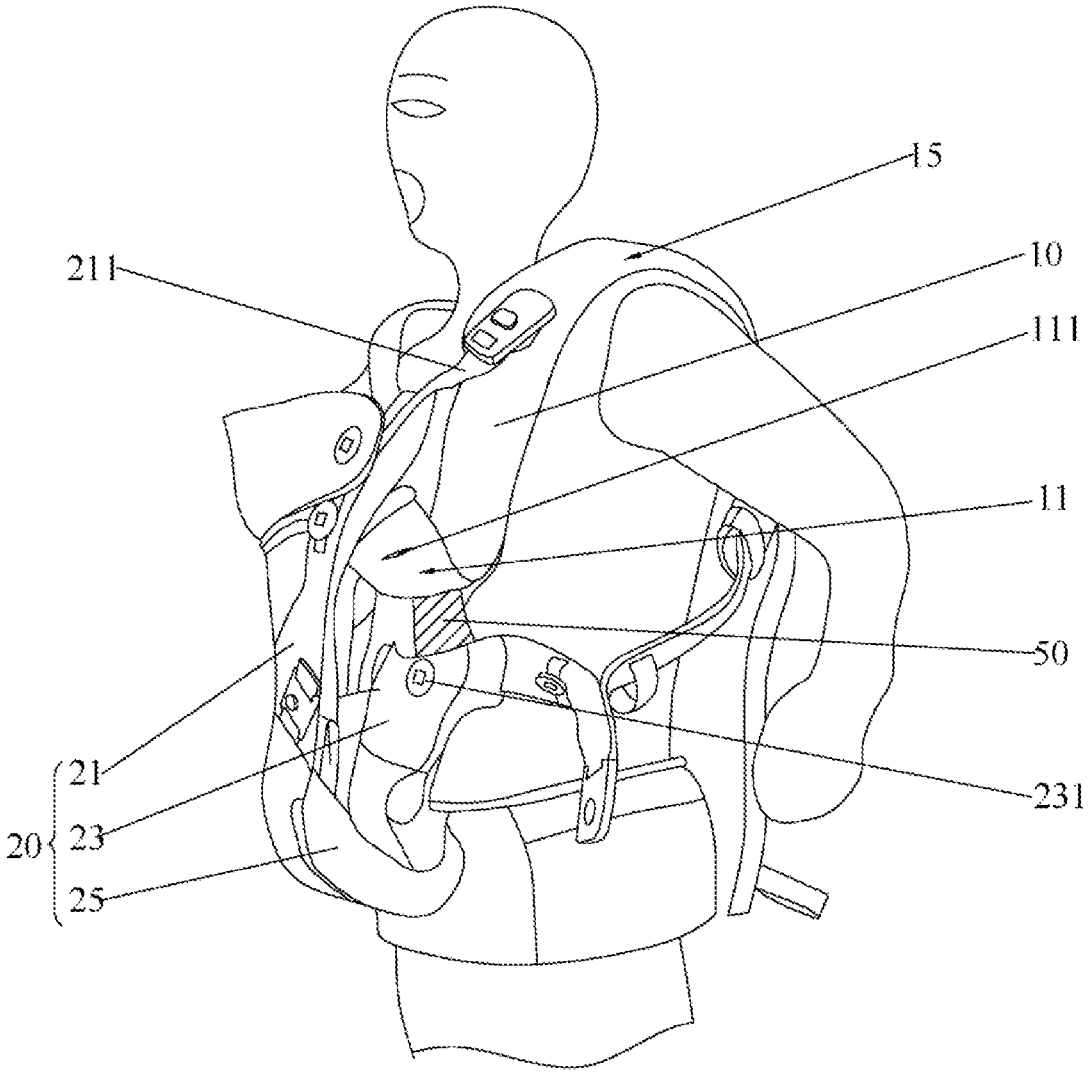
FIG. 7 is a diagrammatic representation illustrating a usage status of a detachable baby carrier having a connecting band.
Figure 8:
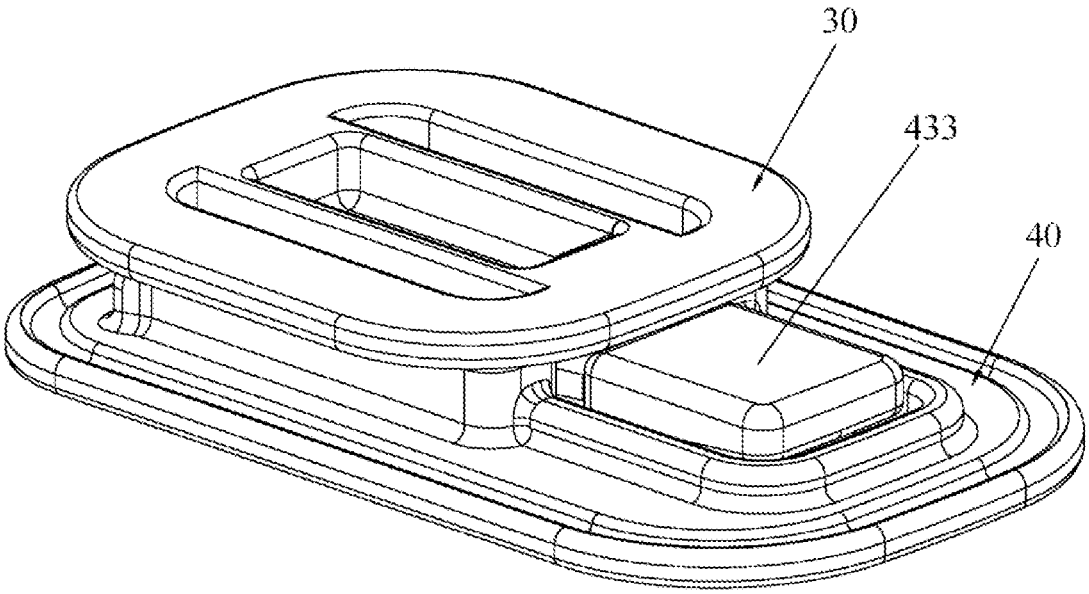
FIG. 8 is a perspective view of a male buckle and a female buckle of the detachable baby carrier matched to each other.
Figure 9:
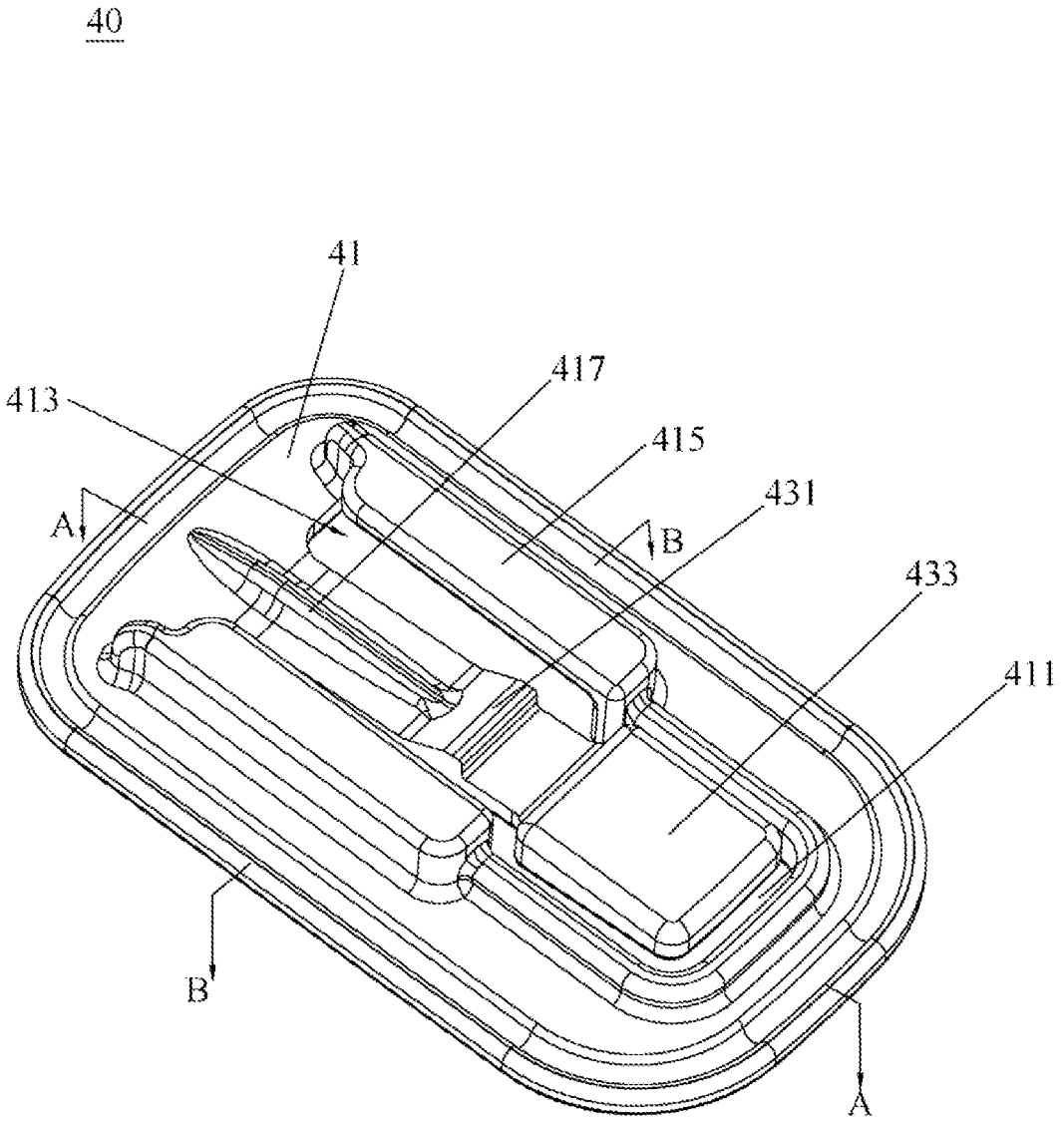
FIG. 9 is a perspective view of the female buckle of FIG. 8.
Figure 10:
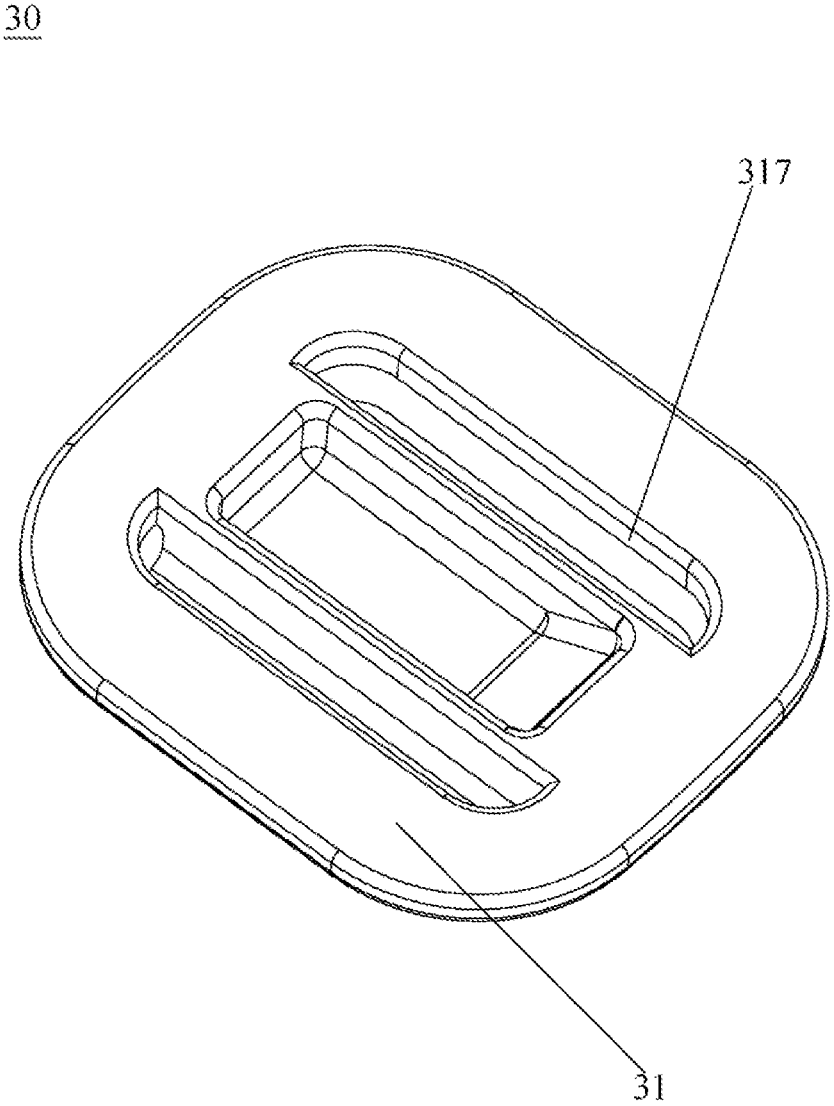
FIG. 10 is a perspective view of the male buckle of FIG. 8.
Figure 11:
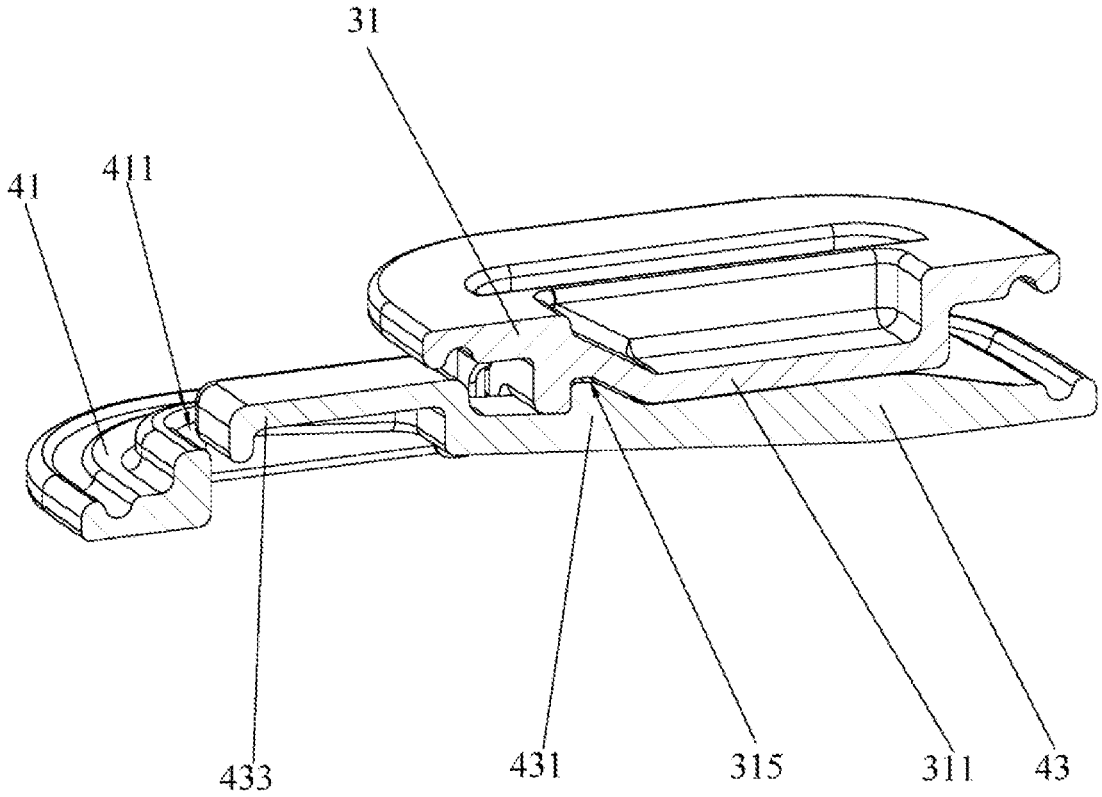
FIG. 11 is a cross section view taken along line A-A of FIG. 9.
Figure 12:
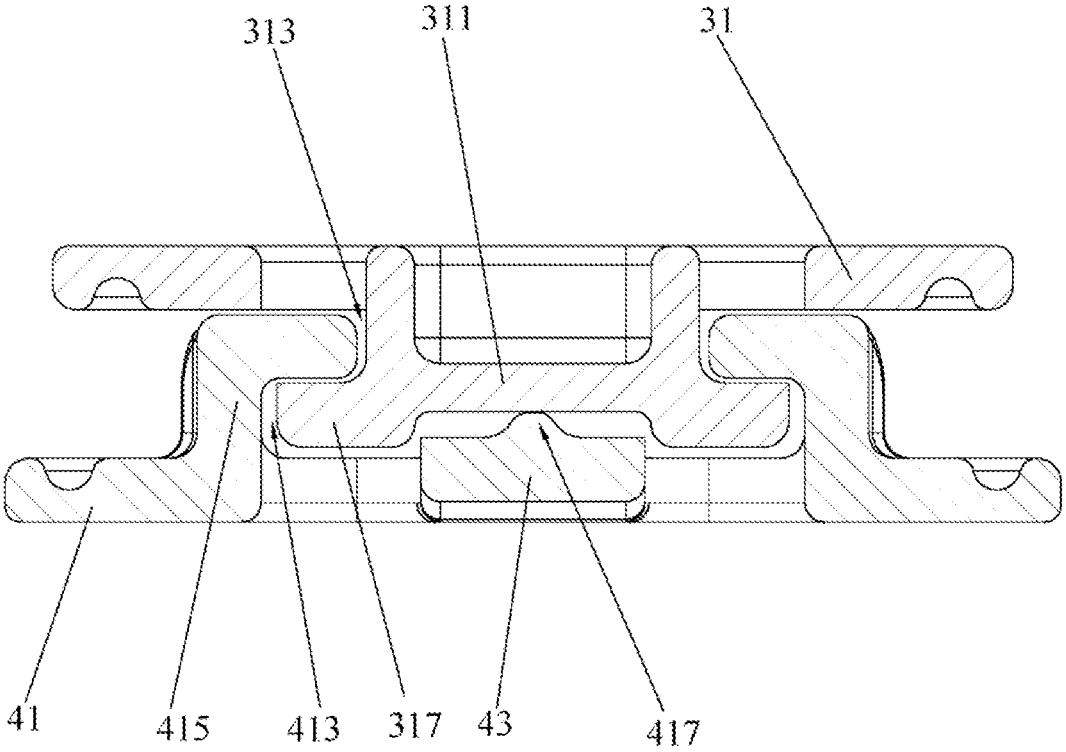
FIG. 12 is a cross section view taken along line B-B of FIG. 9.

Referring to FIG. 7, in one embodiment, the detachable baby carrier 100 further includes a connecting band 50 having elasticity. One end of the connecting band 50 is connected to the auxiliary portion 23, and the other end of the connecting band 50 is connected to the shoulder strap 10 located between the first connecting end 11 and the shoulder contact section 15. After the first connecting end 11 is detached from the auxiliary portion 23, the shoulder strap 10 is able to be pulled to one side due to the elasticity of the connecting band 50, instead of completely removing the shoulder strap 10, thereby providing space for the mother to breastfeed the baby. In such a configuration, the shoulder strap 10 continues to provide support for the baby as the strap 10 is still worn on the shoulder of the wearer, to make the baby in the baby carrier more stable and safe without shaking. In this embodiment, a button hole in and a button 231 can be used to achieve a detachable function to reduce cost. Specifically, the auxiliary portion 23 is sewn with a button 231, and the first connecting end 11 is provided with a button hole 111 to match with the button 231. When there is a need to breastfeed the baby, the button 231 is released before the shoulder strap 10 is pulled. In other embodiments, other detachable mechanisms can be used such as snaps, clasps, or the like.

In comparison with the prior art, the first connecting end 11 in the detachable baby carrier 100 of an embodiment according to the present disclosure is detachably connected to the support member 20, and the first connecting end 11 can be detached from the support member 20 when there is a need to breastfeed, so that the shoulder strap 10 can be easily moved thereby providing space for mothers to breastfeed their babies, which is convenient. Furthermore, due to the connector 211, the baby's weight can be well supported, and meanwhile the bearing weight of the mother's hand for carrying the baby when breastfeeding is lightened.

In one aspect of an embodiment of the present disclosure, there is provided a detachable baby carrier which is easy to detach the shoulder straps to provide space for the mother to breastfeed the baby.

Accordingly, one or more embodiments of the present disclosure provides a detachable baby carrier including two shoulder straps and a support member, wherein a space for receiving a baby is formed by the shoulder straps and the support member, each shoulder strap has a first connecting end and a second connecting end which are respectively connected to the support member, and the first connecting end is detachably connected to the support member.

In comparison with the prior art, in the detachable baby carrier of one or more embodiments of the present disclosure, the first connecting end is detachably connected to the support member, and the first connecting end can be detached from the support member when there is a need to breastfeed, so that the shoulder strap can be easily moved thereby providing space for mothers to breastfeed their babies, which is convenient.

In at least one embodiment, each shoulder strap further includes a shoulder contact section between the first connecting end and a second connecting end, and the support member includes a connector connected to a position of the shoulder strap between the first connecting end and a second connecting end. Due to the existence of the connector, the baby's weight can be well supported, and meanwhile the bearing weight of the mother's hand for carrying the baby when breastfeeding is lightened.

In at least one embodiment, the support member includes a backrest, an auxiliary portion and a seat portion, the first connecting end is detachably connected to the auxiliary portion, one end of the connector is connected with the backrest, and another end of the connector is connected with the shoulder strap.

In at least one embodiment, the second connecting end is detachably connected to the backrest.

In at least one embodiment, one of the first connecting end and the auxiliary portion is provided with a male buckle, and another of the first connecting end and the auxiliary portion is provided with a female buckle which is detachably matched with the male buckle.

In at least one embodiment, the female buckle includes a housing having a penetrating slot and a tongue extended from a side wall of the penetrating slot, the tongue includes a locking portion and a driving portion, and a first limiting slot is provided at the housing located at sides of the tongue; the male buckle includes a base plate that is partially bulged to form a protrusion portion on which a second limiting slot is provided to cooperate with the first limiting slot; a recess is formed on the protrusion portion to engage with the locking portion, and the driving portion is operated to drive the recess to disengage from the locking portion, thereby detaching the female buckle and the male buckle.

In at least one embodiment, the housing includes two limiting plates that are bent toward each other to form the first limiting slot with an opening, the protrusion portion has two side walls that are extended oppositely and extended into the first limiting slot to form the second limiting slot.

In at least one embodiment, one side of the tongue that faces toward the male buckle is provided with the driving portion that is protruded.

In at least one embodiment, the locking portion is in a slope shape.

In at least one embodiment, a reinforcing member is provided between the housing and the locking portion along an extending direction of the tongue.

In at least one embodiment, the detachable baby carrier further includes a connecting band having elasticity, one end of the connecting band is connected to the auxiliary portion, and another end of the connecting band is connected to the shoulder strap located between the first connecting end and the shoulder contact section.

In at least one embodiment, the auxiliary portion is sewn with a button, and the first connecting end is provided with a button hole to match with the button.

In at least one embodiment, the detachable baby carrier further includes a waistband connected to the support member.

One or more embodiments of the present disclosure will become clearer through the following description in conjunction with the accompanying drawings, which are used to explain the embodiments of the present disclosure.

While the present disclosure has been described in connection with what are presently considered to be the most practical and preferred embodiments, it is to be understood that the present disclosure is not to be limited to the disclosed embodiments, but on the contrary, is intended to cover various modifications and equivalent arrangements included within the spirit and scope of the present disclosure.

What is claimed is:

1. A detachable baby carrier, comprising two shoulder straps and a support member, a space for receiving a baby being formed by the shoulder straps and the support member, each shoulder strap having a first connecting end and a second connecting end, the first connecting end being detachably connected to the support member, wherein the first connecting end includes a detachable mechanism on an inner side of the corresponding shoulder strap and configured to be detachedly connected to a detachable mechanism of the support member, and the second connecting end being detachably connected to an outer side of the support member, wherein the support member comprises a connector connected to a first shoulder strap of the two shoulder straps between the first connecting end and the second connecting end of the first shoulder strap.

2. The detachable baby carrier of claim 1, wherein each shoulder strap further comprises a shoulder contact section between the first connecting end and the second connecting end.

3. The detachable baby carrier of claim 2, wherein the support member comprises a backrest, an auxiliary portion, and a seat portion, the first connecting end is detachably connected to the auxiliary portion, one end of the connector is connected with the backrest, and another end of the connector is connected with the shoulder strap.

4. The detachable baby carrier of claim 3, wherein the second connecting end is detachably connected to the backrest.

5. The detachable baby carrier of claim 3, wherein one of the first connecting end or the auxiliary portion is provided with a male buckle, and another of the first connecting end or the auxiliary portion is provided with a female buckle which is detachably matched with the male buckle.

6. The detachable baby carrier of claim 5, wherein the female buckle comprises a housing having a penetrating slot and a tongue extended from a side wall of the penetrating slot, the tongue includes a locking portion and a driving portion, and a first limiting slot is provided at the housing located at sides of the tongue; the male buckle includes a base plate that is partially bulged to form a protrusion portion on which a second limiting slot is provided to cooperate with the first limiting slot; a recess is formed on the protrusion portion to engage with the locking portion, and the driving portion is operable to drive the recess to disengage from the locking portion, thereby detaching the female buckle and the male buckle.

7. The detachable baby carrier of claim 6, wherein the housing comprises two limiting plates that are bent toward each other to form the first limiting slot with an opening, the protrusion portion has two side walls that are extended oppositely and extended into the first limiting slot to form the second limiting slot.

8. The detachable baby carrier of claim 6, wherein one side of the tongue that faces toward the male buckle is provided with the driving portion that is protruded.

9. The detachable baby carrier of claim 6, wherein the locking portion has a sloped shape.

10. The detachable baby carrier of claim 6, wherein a reinforcing member is provided between the housing and the locking portion along an extending direction of the tongue.

11. The detachable baby carrier of claim 3, further comprising a connecting band having elasticity, one end of the connecting band being connected to the auxiliary portion, and another end of the connecting band being connected to the shoulder strap located between the first connecting end and the shoulder contact section.

12. The detachable baby carrier of claim 3, wherein the auxiliary portion is sewn with a button, and the first connecting end is provided with a button hole to match with the button.

13. The detachable baby carrier of claim 1, further comprising a waistband connected to the support member.

14. A detachable baby carrier, the carrier comprising: a support member; and two shoulder straps connected to the support member, wherein the two shoulder straps and the support member form a space for receiving a baby, each shoulder strap has a first and second connecting end, each second connecting end is detachably connected to an outer side of the support member, and each first connecting end includes a detachable mechanism on an inner side of the corresponding shoulder strap and configured to be detachedly connected to a detachable mechanism of the support member, wherein the support member comprises a connector connected to at least one shoulder strap of the two shoulder straps between the first connecting end and the second connecting end of the at least one shoulder strap.

15. The detachable baby carrier of claim 14, wherein the support member comprises a backrest, an auxiliary portion, and a seat portion, the first connecting end is detachably connected to the auxiliary portion, one end of the connector is connected with the backrest, and another end of the connector is connected with the at least one shoulder strap.

16. The detachable baby carrier of claim 15, wherein the second connecting end and the backrest are detachably connected to each other.

17. The detachable baby carrier of claim 14, wherein one of the first connecting end or the support member has a male buckle, and the other of the first connecting end or the support member has a female buckle, the male and female buckle are detachably matched with each other.

18. The detachable baby carrier of claim 17, wherein the female buckle comprises a housing having a penetrating slot and a tongue extended from a side wall of the penetrating slot, the tongue includes a locking portion and a driving portion, and a first limiting slot is formed by the housing located at sides of the tongue; the male buckle includes a base plate that is partially bulged to form a protrusion portion on which a second limiting slot is formed to cooperate with the first limiting slot; a recess is formed on the protrusion portion to engage with the locking portion, and the driving portion is operable to drive the recess to disengage from the locking portion, thereby detaching the female buckle and the male buckle.

19. The detachable baby carrier of claim 18, wherein the housing comprises two limiting plates bent toward each other to form the first limiting slot with an opening, the protrusion portion has two side walls that are extended oppositely and extended into the first limiting slot to form the second limiting slot.

* * * * *